United States Patent [19]

Bryant

[11] 4,326,443

[45] Apr. 27, 1982

[54] INTEGRATED ORGAN CIRCUIT

[75] Inventor: Richard W. Bryant, San Jose, Calif.

[73] Assignee: National Semiconductor Corporation, Santa Clara, Calif.

[21] Appl. No.: 145,415

[22] Filed: May 1, 1980

[51] Int. Cl.[3] ..... G10H 1/02

[52] U.S. Cl. ..... 84/1.26; 84/1.13

[58] Field of Search ..... 84/1.13, 1.26

[56] References Cited

U.S. PATENT DOCUMENTS

| | | | |
|---|---|---|---|
| 3,665,091 | 5/1972 | Hirano | 84/1.26 |
| 4,173,916 | 11/1979 | Inoue et al. | 84/1.13 |
| 4,200,022 | 4/1980 | Carley et al. | 84/1.26 |
| 4,203,337 | 5/1980 | Schwartz et al. | 84/1.26 |
| 4,253,369 | 3/1981 | Hoskinson | 84/1.26 |

*Primary Examiner*—J. V. Truhe
*Assistant Examiner*—Forester W. Isen
*Attorney, Agent, or Firm*—Gail W. Woodward; James A. Sheridan; Neil B. Schulte

[57] ABSTRACT

An MOS integrated organ circuit compensates an audio frequency signal for variations in amplitude, attack and decay characteristics caused by process variations by adjusting a single variable reference voltage. The circuit intrinsically provides for the tracking of these characteristics, such that the attack and decay characteristics are calibrated by adjusting the variable reference voltage to provide a specified amplitude characteristic.

8 Claims, 9 Drawing Figures

INTEGRATED ORGAN CIRCUIT

BACKGROUND OF THE INVENTION

1. Field of the Invention

The present invention relates generally to envelope generators and keyer circuits used in electronic organs. More specifically, the preferred embodiment of the present invention relates to an envelope circuit which can be adjusted to compensate for process variations occurring during the manufacture of an integrated envelope generator and keyer circuit.

2. Description of the Prior Art

Conventional circuits for electronic organs have tone generator circuits for providing a signal having a selected frequency, typically 60–12,000 Hz, and envelope generator circuits for providing a signal characterized by a maximum amplitude, a rise or attack time to reach that amplitude once a key has been depressed, and a fall or decay time for the signal to decay from the maximum amplitude to a zero amplitude once the key has been released. These two signals are mixed in response to the activation of an organ key to produce the desired audio output frequency signal. However, process variations in the manufacture of integrated circuits affect the value of the maximum amplitude, the attack time and the decay time in different ways. It is, therefore, desirable to compensate integrated organ circuits so that the amplitude, attack and decay characteristics stay within desired tolerances.

SUMMARY OF THE INVENTION

In the preferred embodiment of the present invention, first and second transistors selectively charge or discharge a capacitive line in response to clock signals applied to their gates. The capacitive line is coupled to the gate of a third transistor which gates an audio frequency tone signal. The amplitudes of the clock signals and of the signal applied to the source of the first transistor are varied to adjust the maximum amplitude, attack time and decay time of the gated audio frequency signal.

Figure 1:
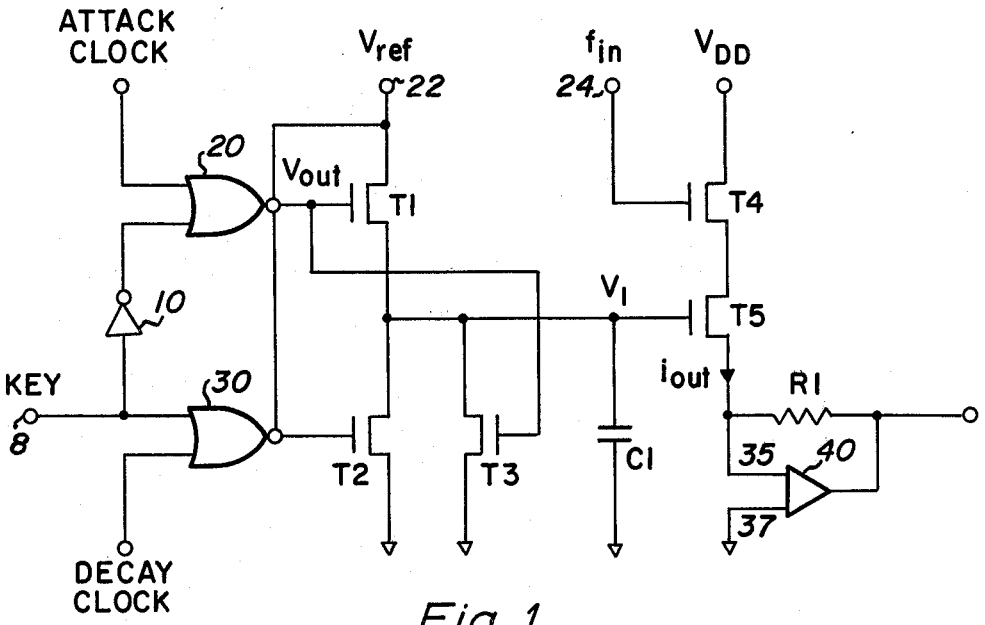
FIG. 1 is a detailed schematic diagram of a keyer circuit constructed in accordance with the preferred embodiment of the present invention.

FIGS. *2a–2e* illustrate waveforms descriptive of signals present during the operation of the keyer circuit of FIG. 1.

Figure 3:
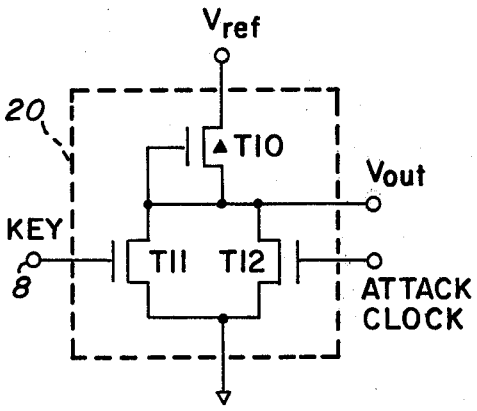

FIG. 3 is a detailed schematic diagram of NOR gate 20 of FIG. 1.

Figure 4:
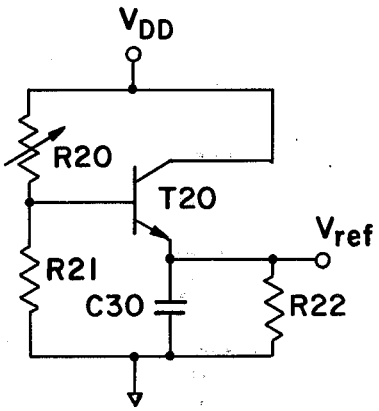

FIG. 4 is a detailed schematic diagram of an emitter follower circuit for providing the reference voltage $V_{ref}$.

Figure 5:
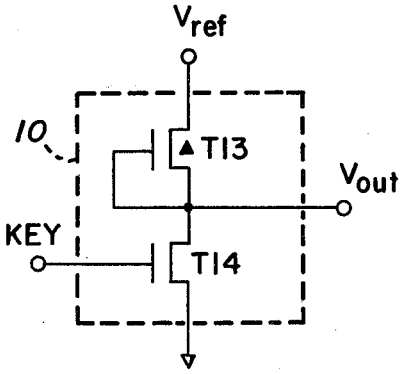

FIG. 5 is a detailed schematic diagram of inverter 10 of the keyer circuit of FIG. 1.

DETAILED DESCRIPTION OF THE PREFERRED EMBODIMENT

The preferred embodiment of the present invention is a circuit forming a portion of an integrated circuit for use in an electronic organ. The integrated circuit is packaged in a 28 pin dual in-line package and contains circuitry for implementing chord and base functions. The integrated circuit provides for 3 audio outputs, 2 for chords and 1 for base, and for a digital interface with other integrated circuits which may provide for additional chord and base functions in the organ. The digital interface utilizes a common supply voltage, preferably about 9 volts, and a reference ground voltage, preferably about zero volts, to establish the voltage levels of the logical "1"and "0" respectively.

FIG. 1 is a detailed schematic diagram of a keyer circuit constructed in accordance with a preferred embodiment of the present invention. In general, the keyer circuit of FIG. 1 supplies an audio signal $i_{out}$ having a frequency $f_{in}$ and characterized by 3 envelope parameters; a maximum amplitude $i_{max}$, an attack time $t_a$ and a decay time $t_d$ as illustrated in FIG. *2e*. Output signal $i_{out}$ is preferably an audio signal having $i_{max}$ equal to 100 $\mu$A and is applied to a virtual ground provided at input terminal 35 of operational amplifier 40 as illustrated in FIG. 1.

Preferably, the attack time $t_a$ is approximately 0.5 milliseconds and the decay time $t_d$ approximately 16.5 milliseconds when external capacitor C1 has a value of 0.47 $\mu$f and the attack and decay clock inputs are held at logic "0" levels. However, process variations in the production of the integrated circuits results in varying gains and thresholds for the different devices. This causes variations in the maximum amplitude $i_{out}$, the attack time $t_a$ and the decay time $t_d$. It is therefore desirable to provide for an adjustment to compensate the keyer circuit for process variations and to calibrate the envelope parameters $i_{out}$, $t_a$ and $t_d$. Since production processes and thus the envelope parameters may vary from chip to chip, an independent adjustment is required for each chip.

The keyer circuit of FIG. 1 has a key terminal 8 for receiving a key signal having a logic "1" voltage in response to the depression of an organ key. When the key associated with the keyer circuit is released, the signal provided on key terminal 8 will have a logic "0" voltage. Key terminal 8 is coupled to an input of inverter 10 which has an output coupled to one input of NOR gate 20. The other input of NOR gate 20 is coupled to receive an attack clock signal. The attack clock signal is a signal having a frequency above the audio range, preferably about 50 kHz. The attack clock is preferably a square wave signal having logic level amplitudes and a variable duty cycle as illustrated in FIG. *2a*. The duty cycle of the attack clock signal is variable from zero to 100% where a 100% duty cycle corresponds to an attack clock signal having a constant logic "0" voltage, and the output signal $i_{out}$ is characterized by an attack time of $t_a$. The attack time $t_a$ can be increased by reducing the duty cycle of the attack clock signal.

The output of NOR gate 20 has an output amplitude logically selected from a reference voltage level $V_{ref}$ or a ground voltage. The reference voltage $V_{ref}$ is an adjustable DC potential supplied to the reference terminal 22 having an amplitude adjustable between 3–7 volts and having a source impedance of less than 25 ohms. Adjustment of the reference voltage $V_{ref}$ provides the calibration of the 3 envelope parameters as explained in detail below.

In operation, capacitor C1 will be charged at a rate determined by the conducting resistance of transistor T1 and the capacitance of capacitor C1 in response to a logic "1" level signal on the gate of transistor T1. Capacitor C1 is an external capacitor external to the integrated circuit and preferably has a capacitance of 0.47 microfarads.

Figure 2:
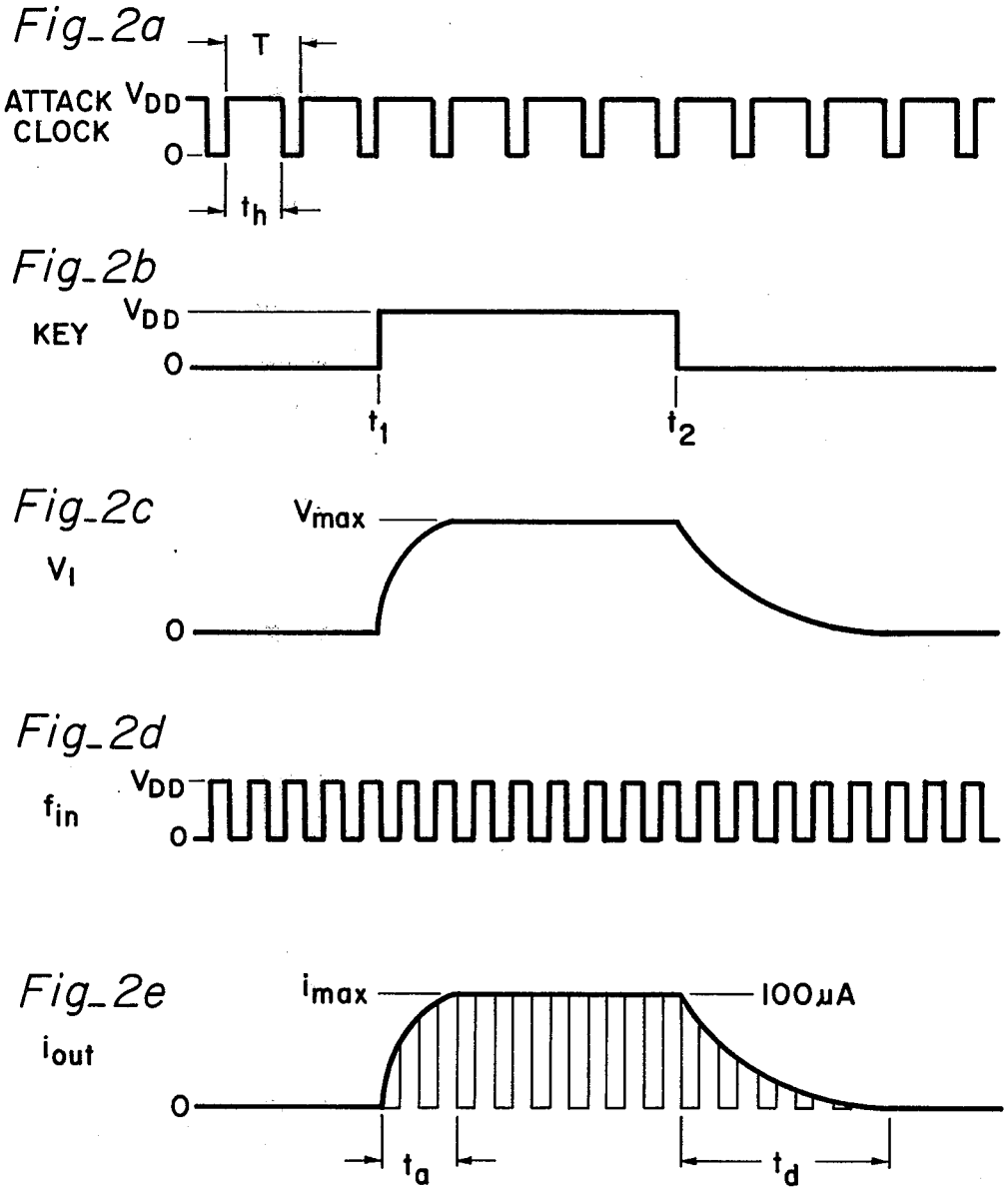

The key signal applied to key terminal 8 is directly applied to a first input terminal of NOR gate 30. A second input terminal to NOR gate 30 is coupled to receive a decay clock signal which is similar to the attack clock signal. That is, the decay clock signal has a frequency above the audio range, preferably about 50 kHz. The decay clock signal is preferably a squarewave signal having logic level amplitudes and a variable duty cycle as illustrated in FIG. 2*a*. The duty cycle of the decay clock is variable from zero to 100%, where a 100% duty cycle corresponds to the decay clock signal having a constant logic "0" voltage and a decay time of $t_d$. By reducing the duty cycle of the decay clock signal, the decay time $t_d$ can be adjusted to provide for longer decay times.

The output of NOR gate 30 has an output amplitude equal to either the reference voltage level $V_{ref}$ or to ground. This output is applied to a gate of transistor T2 and causes a capacitor C1 to discharge to ground in response to the output having a high level signal equal to $V_{ref}$.

Transistor T4 has a gate coupled to receive a tone signal $f_{in}$ applied to tone terminal 24, a drain coupled to receive a voltage supply $V_{DD}$ and a source coupled to a drain of transistor T5. Tone signal $f_{in}$ is an audio frequency squarewave having alternating levels of a logic "1" and a logic "0" as illustrated in FIG. 2*d*. Tone signal $f_{in}$ is gated by transistor T5 which has a gate coupled to the first terminal of capacitor C1 to receive the gating voltage of $V_1$ and has a source coupled to input 35 of an operational amplifier 40.

The output signal $i_{out}$ provided by transistor T5 is illustrated in FIG. 2*e* and is characterized by the mixing of the envelope of voltage $V_1$ and tone signal $f_{in}$. The output signal $i_{out}$ is a variable current audio signal and is supplied to the virtual ground of input 35 of operational amplifier 40 which has an inverting terminal 37 coupled to a ground voltage and has a feedback resistor $R_1$ in a negative feedback loop Operational amplifier 40 thus provides a means for summing a number of audio current signals. These summed audio signals are then processed by filters, audio amplifiers and eventually, applied to speakers to produce sounds characteristic of an electronic organ.

To a first approximation, the maximum voltage attained by gating voltage $V_1$, is equal to the reference voltage $V_{ref}$ less the threshold voltage $V_{th}$ of transistor T1. More accurately, since the source of transistor T1 is at a potential greater than the bulk, the operating threshold voltage $V_{th}$ has a value greater than the intrinsic threshold voltage $V_{to}$. However, this first approximation is only valid if transistor T1 is biased in its normal operating mode characterized by a microamp or greater source to drain currents. In fact, this approximation is invalid in a 0.15 to 0.20 volt transistion region which is characterized by subthreshold conduction wherein a sub-microamp current flows through transistor T1. This sub-microamp current causes the gating voltage V1 to ramp slowly to a voltage approximately 0.15 to 0.20 volts higher than the reference voltage $V_{ref}$ less the operating threshold voltage $V_{th}$. It is desirable to eliminate this ramping effect and to maintain transistor T1 in either a cutoff or a normal conducting mode so that the gating voltage $V_1$ stabilizes at a constant amplitude after the attack time $t_a$.

Transistor T3 has a drain coupled to the source of transistor T1, a source coupled to ground and a gate coupled to the output of NOR gate 20. Transistor T3 is coupled to conduct when transistor T1 is in its conductive mode and is designed to have a low conduction current relative to transistor T1, preferably in the microamp range. The conduction current of transistor T3 is thus less than the normal mode conduction current of transistor T1 but is greater than the subthreshold conduction current of transistor T1. This causes transistor T1 to stabilize at a current when gating voltage $V_1$ reaches a maximum approximately equal to the reference voltage $V_{ref}$ less 1.85 volts. This is in comparison to the preferred 1.8 volt operating threshold voltage of transistor T1 ($V_{th}$) and the 1.2 volt intrinsic voltage of transistor T1 ($V_{to}$). Thus, transistor T1 is biased to conduct slightly when the gating voltage is at its maximum value as illustrated in FIG. 1.

If it is desirable to have the output current $i_{out}$ asymptotically approach zero after the decay time $t_d$, the source of transistor T2 can be coupled to a voltage source having a value approximately equal to the threshold voltage $V_{th}$ of transistor T5. Typically, this threshold voltage is in the range of 0.4 to 1 volts. This connection is well-known to persons skilled in the art and is within the scope of the preferred embodiment of the present invention.

In an alternative embodiment of the present invention the signals clocking the gates of transistors T1 and T2 are provided by variable width single shots triggered at a fixed frequency. In this embodiment, the attack and decay clock signals control the width of single shot pulses. In yet another alternative embodiment, the signals clocking the gates of transistors T1 and T2 are provided by fixed width single shots triggered at frequencies responsive to the attack and decay clock signals.

The envelope parameters $i_{out}$, $t_a$ and $t_d$ vary with the process variations from chip to chip. Specifically, the envelope of parameters vary with the threshold voltages in gains of transistors T1, T2 and T5. It has been discovered that in the present invention the envelope parameters tend to track. That is, a chip characterized by low output signal $i_{out}$ also tends to have a longer attack time $t_a$ and decay time $t_d$. The reference voltage $V_{ref}$ has been coupled such that the envelope parameters will also track as the reference voltage is adjusted. Specifically, in the present circuit the attack time $t_a$ and the decay time $t_d$ are typically within 20% of their preferred values when the reference $V_{ref}$ is adjusted in the range of 3 to 7 volts to provide a 100 microamp output current $i_{out}$. Thus, a single adjustment for each chip calibrates all three envelope parameters of the keyer circuit on that chip.

In an alternate embodiment of the present invention, the drain of transistor T1 could be coupled to the supply voltage $V_{DD}$. Further, the reference voltage $V_{ref}$ could be coupled to the drain of transistor T4. However, it is preferred to couple the drains of transistors T1 and T4 as illustrated in FIG. 1 as this provides the best tracking.

FIG. 3 is a detailed schematic diagram of NOR gate 20. The reference voltage $V_{ref}$ is coupled to the drain of depletion transistor T10. The key terminal 8 provides a key signal to the gate of transistor T11 which has a drain coupled to the gate and source of depletion transistor T10 and a drain coupled to the ground voltage. A transistor T12 has a drain coupled to the source of transistor T10, a source coupled to the ground voltage and a gate coupled to receive an attack clock signal. Depletion transistor T10 is always on; however, the conductin resistance of depletion transistor T10 is greater than the conducting resistance of either of the enhancement transistors T11 or T12; thus, the output voltage $V_{out}$ at the source of transistor T12 is substantially equal to the reference voltage $V_{ref}$ when the signals applied to the gates of transistors T11 and T12 have a logic "0" level and is substantially equal to the ground voltage in response to a logic "1" level signal being applied to either of the gates of enhancement transistor T11 or enhancement transistor T12.

A typical circuit for providing the reference $V_{ref}$ to the present circuit is the emitter follower circuit illustrated in FIG. 4. The voltage supply $V_{DD}$ is coupled to a first terminal of adjustable resistor R20 which is coupled in series between the supply voltage $V_{DD}$ and ground with resistor R21. The intermediate connection between the resistors is coupled to the gate of NPN transistor T20 which has collector coupled to the supply voltage $V_{DD}$, and an emitter coupled to first terminals of capacitor $C_{30}$ and resistor $R_{22}$. The second terminals of capacitor $C_{30}$ and resistor $R_{22}$ are coupled to ground. The desired low impedance adjustable voltage $V_{ref}$ source is obtained at the emitter of transistor T20. In the preferred embodiment, the elements of the emitter follower circuit have the values shown in Table 1.

TABLE 1

| |
|---|
| $R_{21}$ = 3000 ohms |
| $R_{20}$ = 1-6 K ohms |
| $C_{30}$ = 10 uf |
| $R_{22}$ = 3K ohms |

FIG. 5 is a detailed schematic diagram of inverter 10 of FIG. 1. Inverter 10 operates in the same manner as NOR gate 20, described above and illustrated in FIG. 3, except that it has only one input terminal and only one transistor for selectively coupling the output to ground.

The preferred embodiment of the present invention is constructed of all N-channel enhancement devices. The specific sizes of the devices are given in Table 2. The threshold voltage $V_{to}$ for these devices is in the range of 0.6 to 1.2 volts.

TABLE 2

| Device | Width/Length (in mils) |
|---|---|
| T1 | 3.7/.3 |
| T2 | .6/1.8 |
| T3 | .2/20 |
| T4 | 2/.5 |
| T5 | 2/.5 |
| T10 | .2/1.3 (100-200uA/square) |
| T11 | .3/.2 |
| T12 | .3/.2 |
| T13 | .2/1.3 (100-200uA/square) |
| T14 | .3/.2 |

I claim:

1. An MOS integrated organ circuit having a digital interface for communicating with other integrated circuits, the digital interface characterized by logic signals having voltages substantially equal to either a supply voltage or a ground voltage, and having a keyer circuit for providing an output signal characterized by a maximum amplitude, an attack time and a decay time in response to a key signal and a tone signal, the integrated organ circuit comprising:

variable reference means for providing a variable reference voltage;

first gate means coupled to receive the key signal and the variable reference voltage for providing an attack signal in response to the key signal having a first amplitude, the amplitude of the attack signal being responsive to the amplitude of the variable reference voltage;

second gate means coupled to receive the key signal and the variable reference voltage for providing a decay signal in response to the key signal having a second amplitude, the amplitude of the decay signal being responsive to the amplitude of the variable reference voltage:

a first transistor having a drain coupled to a source of voltage, a gate coupled to the first gate means to receive the attack signal and a source;

a second transistor having a drain coupled to the source of the first transistor, a gate coupled to the second gate means to receive the decay signal, and a source coupled to the ground voltage;

capacitance means for providing a capacitance between the source of the first transistor and the fixed ground voltage; and a third transistor, having a gate coupled to the source of the first transistor, a drain coupled to receive the tone signal and a source for providing the output signal.

2. An MOS integrated organ circuit as in claim 1 wherein the first and second gate means are further coupled to receive binary attack and decay clock signals respectively, the attack and decay signals being squarewaves with a maximum amplitude responsive to the amplitude of the variable reference voltage and the duty cycle of the attack and decay signals responsive to the duty cycle of the attack and decay clock signals respectively.

3. An MOS integrated organ circuit as in claim 2 wherein the source of voltage coupled to the drain of the first transistor is the variable reference means.

4. An MOS integrated organ circuit as in claim 2 further comprising a fourth transistor having a drain coupled to the source of the first transistor, a gate coupled to the gate of the first transistor, and a source coupled to the ground voltage, the conducting impedance of the fourth transistor being a least ten (10) times the conducting impedance of the first transistor.

5. An MOS integrated organ circuit as in claim 4 further comprising:

a fifth transistor having a gate coupled to receive the tone signal, a drain coupled to a source of voltage, and a source coupled to the drain of the third transistor.

6. An MOS integrated organ circuit as in claim 5 wherein the source of voltage coupled to the drain of the fifth transistor is the supply voltage.

7. An MOS integrated organ circuit as in claim 6 wherein the maximum amplitudes of the attack and decay signals are substantially equal to the amplitude of the variable reference voltage.

8. An MOS integrated organ circuit as in claim 7 wherein the first and second gate means are NOR gates.

* * * * *